US007556100B2

(12) United States Patent
Steiner

(10) Patent No.: US 7,556,100 B2
(45) Date of Patent: Jul. 7, 2009

(54) APPARATUS AND METHOD FOR DELIVERING CHEMICALS INTO AN UNDERGROUND WELL

(75) Inventor: William H. Steiner, Spring, TX (US)

(73) Assignee: BJ Services Company, Houston, TX (US)

( * ) Notice: Subject to any disclaimer, the term of this patent is extended or adjusted under 35 U.S.C. 154(b) by 35 days.

(21) Appl. No.: 11/821,373

(22) Filed: Jun. 22, 2007

(65) Prior Publication Data

US 2008/0023203 A1 Jan. 31, 2008

Related U.S. Application Data

(60) Provisional application No. 60/833,133, filed on Jul. 25, 2006.

(51) Int. Cl.
*E21B 23/08* (2006.01)
*E21B 33/08* (2006.01)
*E21B 27/00* (2006.01)

(52) U.S. Cl. ..... 166/279; 166/68; 166/107; 166/305.1; 166/383; 166/386

(58) Field of Classification Search ..... None
See application file for complete search history.

(56) References Cited

U.S. PATENT DOCUMENTS 3,412,798 A 11/1968 Gregston
3,473,611 A 10/1969 Gregston
5,132,904 A * 7/1992 Lamp ..... 700/282
5,758,725 A 6/1998 Streetman
6,209,637 B1 4/2001 Wells
7,004,258 B2 2/2006 Farris
7,040,401 B1 * 5/2006 McCannon ..... 166/250.15
7,117,947 B2 10/2006 Wilson
2007/0039739 A1 * 2/2007 Wilson ..... 166/369

OTHER PUBLICATIONS

"Introduction to Plunger Lift: Application, Advantages and Limitations"; E. Beauregard & Paul L. Ferguson Ferguson Beauregard; Southwestern Pretroleum Short Course, Department of Petroleum Engineering, Texas Tech University, Lubbock, Texas Apr. 23-24, 1981.

Plunger Enhanced Chamber Lift (PECL™); Ferguson Beauregard; Tyler, Texas.

* cited by examiner

*Primary Examiner*—Zakiya W. Bates
(74) *Attorney, Agent, or Firm*—E. Randall Smith; Jones & Smith, LLP

(57) ABSTRACT

In some embodiments, a method of delivering at least one chemical into an underground well equipped with a reciprocating plunger includes retaining the plunger above the well after the well is unloaded and shut in, dispensing at least one chemical into the well and releasing the plunger so that the plunger may drop in the well after the chemical(s).

24 Claims, 3 Drawing Sheets

APPARATUS AND METHOD FOR DELIVERING CHEMICALS INTO AN UNDERGROUND WELL

This application claims priority to U.S. Provisional Application Ser. No. 60/833,133 filed Jul. 25, 2006 and entitled "Apparatus and Methods for Delivering Chemicals into an Underground Well", the entire disclosure of which is hereby incorporated by reference herein in its entirety.

FIELD OF THE INVENTION

The present invention relates to apparatus and methods for providing at least one chemical into an underground well. In some embodiments, the present invention relates to apparatus and methods for providing treatment chemicals into hydrocarbon producing wells equipped with a plunger lift system.

BACKGROUND OF THE INVENTION

Various artificial lift techniques have been used to improve recovery of oil and/or gas from subterranean reservoirs, such as when production by natural reservoir pressure becomes uneconomical. In particular, plunger lift systems have been effective at improving oil and/or gas recovery in various situations. These systems, for example, often utilize a free-traveling plunger or piston that drops to the bottom of the well. In such systems, also know as free piston systems, as the plunger falls, fluid in the tubing flows around and above the plunger. When desired, one or more wellhead valve is opened, allowing gas in the well to push the plunger up to the surface. As the plunger moves up, liquids above the plunger are pushed to the surface and recovered. This sequence can be repeated by closing the wellhead off and allowing the plunger to fall back into the well.

The ability to produce oil and/or gas from subterranean reservoirs may be enhanced by providing treatment chemicals in the well to reduce viscosity of fluids in the well, corrosion, scale and deposits of undesirable materials, such as paraffin and distillates, in the well or for other purposes. Treatment chemicals can include soap, acid, corrosion inhibitors, scale inhibitors, solvents, dispersants, and inhibitors for paraffin and petroleum distillates, stabilizers, surface active agents and other chemical-based liquids and/or solids.

Various techniques have been employed to deliver treatment chemicals downhole. Some example chemical delivery techniques for use in wells equipped with plunger lift systems are described in U.S. Pat. No. 7,004,258, entitled "Method and Apparatus for Enhancing Oil and Gas Flow in a Well" and issued on Feb. 28, 2006, and U.S. Pat. No. 7,117,947, entitled "Well Chemical Treatment Utilizing Plunger Lift Delivery System" and issued on Oct. 10, 2006.

Existing chemical delivery techniques used in wells equipped with plunger lift systems have limitations. For example, many delivery techniques do not ensure effective delivery of the treatment chemicals to the desired downhole locations. For another example, various existing delivery techniques require the manufacture, installation and effective operation of additional equipment that must be used within the well. For further examples, various existing procedures are uneconomical, unreliable, cumbersome to employ or unsuitable for use in certain wells.

It should be understood, however, that the above-described examples, features and/or disadvantages are provided for illustrative purposes only and are not intended to limit the scope or subject matter of the claims of this patent or any patent or patent application claiming priority hereto. Thus, none of the appended claims or claims of any related patent application or patent should be limited by the above discussion or construed to address, include or exclude the cited examples, features and/or disadvantages, except and only to the extent as may be expressly stated in a particular claim. Further, the above exemplary disadvantages should be evaluated for any particular existing downhole applications on a case-by-case basis.

Accordingly, there exists a need for apparatus and methods useful for providing chemicals into wells equipped with plunger lift systems having one or more of the following attributes, capabilities or features: effectively uses treatment chemicals; minimizes waste of treatment chemicals; assists in providing ideal chemical treatment; assists in ensuring chemicals do not trickle down well or dry up before reaching the well bottom; ensures chemicals are delivered to the well bottom; efficiently delivers chemicals to the desired location in the well; generally uniformly coats the tubing walls with chemicals; provides chemicals into the well quickly at every plunger stroke; repeatedly delivers chemicals to the bottom of the well to prevent scale deposits and/or corrosion; automatically maintains continuous chemical presence in the well; allows nearly continuous treatment of the wellbore; prevents injected chemicals from flowing out of the well with fluid exiting the well; prevents the plunger from preceding chemicals down the well; allows the plunger to be held above the well to allow insertion of chemicals before the plunger drops; allows the plunger to follow the chemicals down the well, pushing chemicals to the bottom, assisting in evenly dispersing chemicals in the borehole or evenly distributing chemicals along the inner surface of the tubing.

BRIEF SUMMARY OF THE INVENTION

In some embodiments, the present invention involves a method of delivering at least one treatment chemical into an underground hydrocarbon well equipped with a reciprocating plunger. The method includes retaining the plunger above the well when the plunger is at an upstroke and shutting in the well. The plunger is retained above the well and at least one treatment chemical is dispensed into the well. The plunger is released, allowing the plunger to drop in the well after the dispensed treatment chemical(s).

In various embodiments, the present invention involves a method of providing chemicals into an underground well equipped with a plunger lift system. The plunger lift system including at least one plunger capable of moving up and down in a tubing disposed in the well and, on its upstroke, pushing well fluid out of the tubing into at least one flow passage. The method includes providing at least one chemical insertion inlet to the tubing. After an upstroke of the plunger, the plunger is held proximate to the top of the well. When desired, the at least one flow passage is closed to prevent fluid flow out of the well. The plunger is held generally above the location of the at least one chemical insertion inlet. Chemicals are inserted into the well through the at least one chemical insertion inlet(s) and the plunger is released to allow the plunger to drop in the well.

There are embodiments of the invention that involve an apparatus for delivering at least one chemical into an underground borehole equipped with a plunger lift system. The plunger lift system includes a plunger capable of moving up and down in the borehole and a plunger catcher capable of holding the plunger generally above the borehole. The apparatus includes at least one chemical supply source, and at least one chemical supply line in fluid communication with the chemical supply source and the borehole. At least one controller is electronically engaged with the plunger catcher and capable of controlling the flow of fluids into the borehole from the chemical supply source. The controller causes chemicals to be provided into the borehole while the plunger is held by the plunger catcher and causes the plunger to be released into the borehole thereafter.

Accordingly, the present invention includes features and advantages which are believed to enable it to advance underground chemical delivery technology. Characteristics and advantages of the present invention described above and additional features and benefits will be readily apparent to those skilled in the art upon consideration of the following detailed description of preferred embodiments and referring to the accompanying drawings.

BRIEF DESCRIPTION OF THE DRAWINGS

The following figures are part of the present specification, included to demonstrate certain aspects of preferred embodiments of the invention and referenced in the detailed description herein.

DETAILED DESCRIPTION OF PREFERRED EMBODIMENTS

Figure 1:
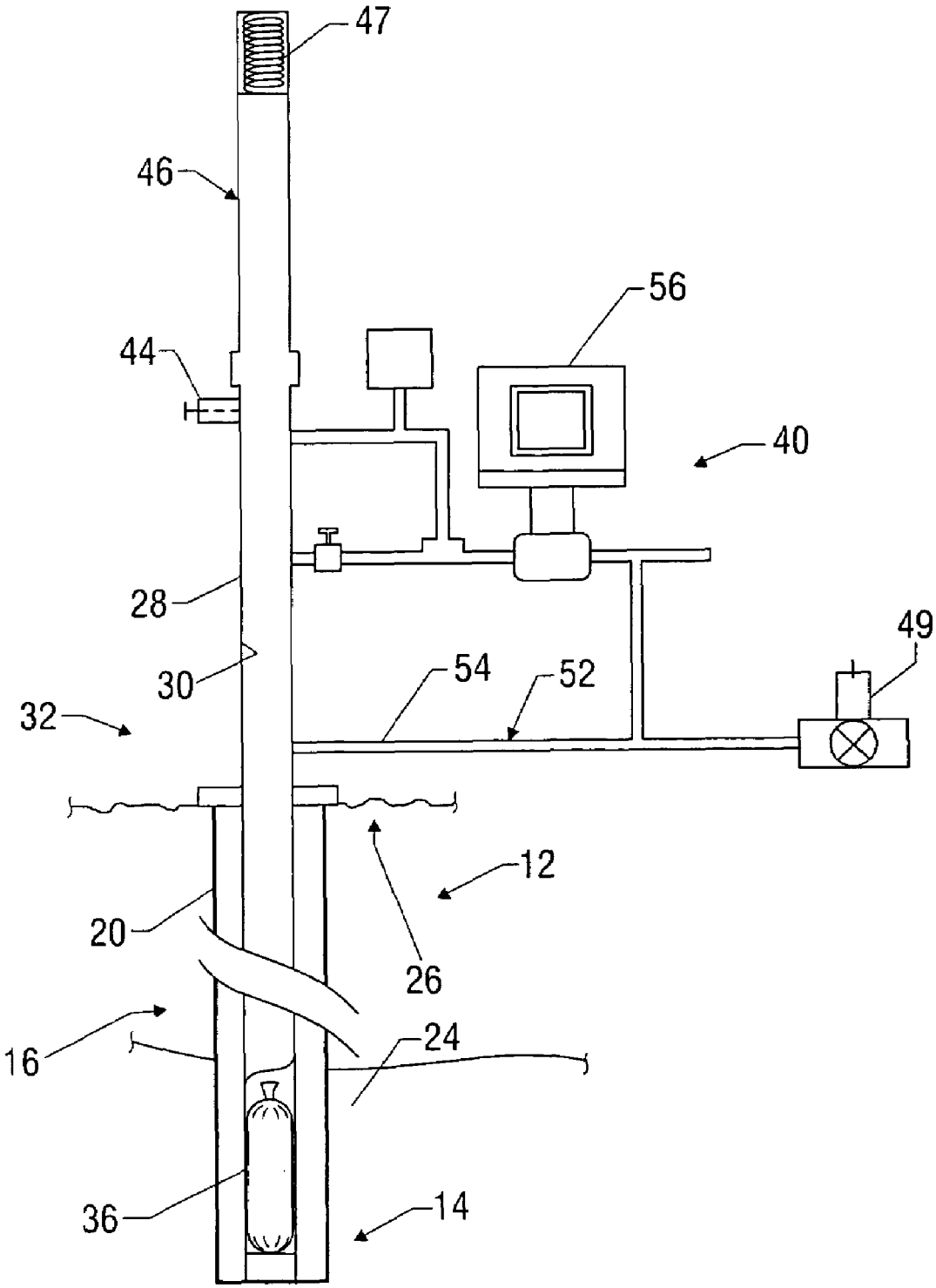
FIG. 1 (Prior Art)
FIG. 1 is a longitudinal schematic showing an exemplary prior art well equipped with a plunger lift system.

Characteristics and advantages of the present invention and additional features and benefits will be readily apparent to those skilled in the art upon consideration of the following detailed description of preferred embodiments of the claimed invention and referring to the accompanying figures. It should be understood that the description herein and appended drawings, being of preferred embodiments, are not intended to limit the appended claims or the claims of any patent or patent application claiming priority to this application. On the contrary, the intention is to cover all modifications, equivalents and alternatives falling within the spirit and scope of the claims. Many changes may be made to the particular embodiments and details disclosed herein without departing from such spirit and scope.

In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout various portions (and headings) of this patent application, the terms "invention", "present invention" and variations thereof are not intended to mean the invention of every possible embodiment of the invention or any particular claim or claims. Thus, the subject matter of each such reference should not be considered as necessary for, or part of, every embodiment of the invention or any particular claim(s) merely because of such reference. Also, it should be noted that reference herein and in the appended claims to components and aspects in a singular tense does not necessarily limit the present invention to only one such component or aspect, but should be interpreted generally to mean one or more, as may be suitable and desirable in each particular instance.

Referring initially to FIG. 1, an example hydrocarbon well 12 equipped with a plunger lift system is shown. The exemplary well 12 may be a gas or oil well, or produce a combination of gas and oil. The well 12 has a wellbore 16 within which a casing 20 extends into the earth to a production zone 24. A tubing 28 is shown installed within the casing 20. A free-traveling plunger 36 is shown in the tubing 28.

Well production flows through the tubing 28 to a wellhead 32. At the exemplary wellhead 32, a manifold 40 includes a plunger catcher 44, such as, for example, an electromagnetic or pneumatic device, capable of engaging and holding the plunger 36 to temporarily prevent it from re-entering the tubing 28 below. The illustrated manifold 40 also includes a lubricator 46 and one or more valve 49 through which gas and/or liquids may flow from the well 12 into a flow passage 52, such as a sales flow line 54. A controller 56 controls the valve(s) 49 and the plunger catcher 44. In this example, based upon the pressure or flow rate in the well 12, the controller 56 can shut-in the well 12 by causing the valve 49, such as a flow control motor valve, to close.

In typical operation of the example of FIG. 1, the plunger 36 provides a mechanical interface between produced liquids and gas in the well 12. Shutting in the well 12 at the surface allows the free traveling plunger 36 to fall to the bottom 14 of the well 12 (or other desired location). Fluids typically pass around the plunger 36 through a space (not shown) between the plunger 36 and the tubing 28, or passageways (not shown) in the plunger 36. When the well 12 is open, such as by opening the valve 49, gas in the well 12 will push the plunger 36 and the liquid above the plunger 36 up the tubing 28 to the surface 26. Using the energy of the well 12 for lift, liquids are thus delivered to the surface 26 by movement of the plunger 36. When the plunger 36 reaches the top of the well 12, it enters or is received by the lubricator 46, which may include a bumper 47 to reduce the impact of the plunger 36. The plunger catcher 44 is activated to hold the plunger 36 until a signal is received to release the plunger 36, which typically occurs as soon as the well is shut-in.

The illustrated controller 56 contains circuitry for opening and closing the appropriate valve(s) 49 during the different phases of the lift process. When flow in the well 12 diminishes to a predetermined flow rate or pressure in the well drops to a predetermined set point, the controller 56 shuts the valve 49 to shut-in the well 12 and release the plunger 36 to drop back into the tubing 28. This cycle is typically repeated numerous times per day.

Additional descriptions of various example plunger lift systems are available in publicly available documents, such as U.S. Pat. No. 6,209,637 entitled "Plunger Lift with Multi-Part Piston and Method of Using the Same" and issued on Apr. 3, 2001, U.S. Pat. No. 7,004,258, entitled "Method and Apparatus for Enhancing Oil and Gas Flow in a Well" and issued on Feb. 28, 2006 and U.S. Pat. No. 7,117,947, entitled "Well Chemical Treatment Utilizing Plunger Lift Delivery System" and issued on Oct. 10, 2006, the disclosures of which are all hereby incorporated by reference herein in their entireties.

Figure 3A:
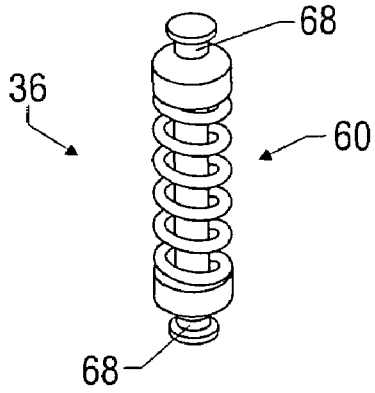
FIG. 3A (Prior Art)
FIGS. 3A, 3B, 3C and 3D are perspective views of example prior art plungers.
Figure 3B:
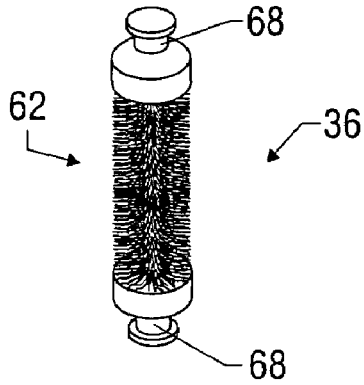
FIG. 3B (Prior Art)
Figure 3C:
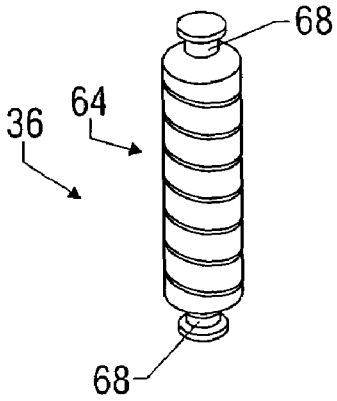
FIG. 3C (Prior Art)
Figure 3D:
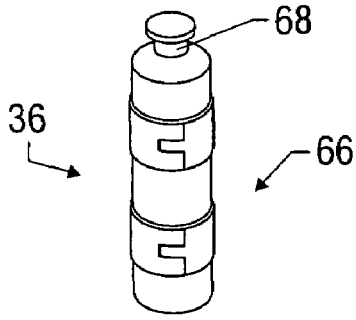
FIG. 3D (Prior Art)

The above-referenced components may have any suitable form, construction, configuration and operation as is or becomes know. Moreover, the above-referenced components are not limiting upon the present invention, the appended claims or the claims of any patent application or patent claiming priority hereto. Accordingly, the present invention may be used in wells that do not include all of the above components or have additional components. For example, the present invention may be used with any suitable plunger and plunger lift system that is or becomes known. Example types of plungers with which the present invention may be used include the coiled tubing plunger 60 of FIG. 3A, the brush plunger 62 of FIG. 3B, the solid bar stock plunger 64 of FIG. 3C and the pad plunger 66 of FIG. 3D, the neck(s) 68 of which may provide an area where the plunger 36 may be engaged by the plunger catcher 44. Yet other types of potentially compatible plungers 36 include wobble washer plungers, snake plungers and multi-part plungers (not shown).

Figure 2:
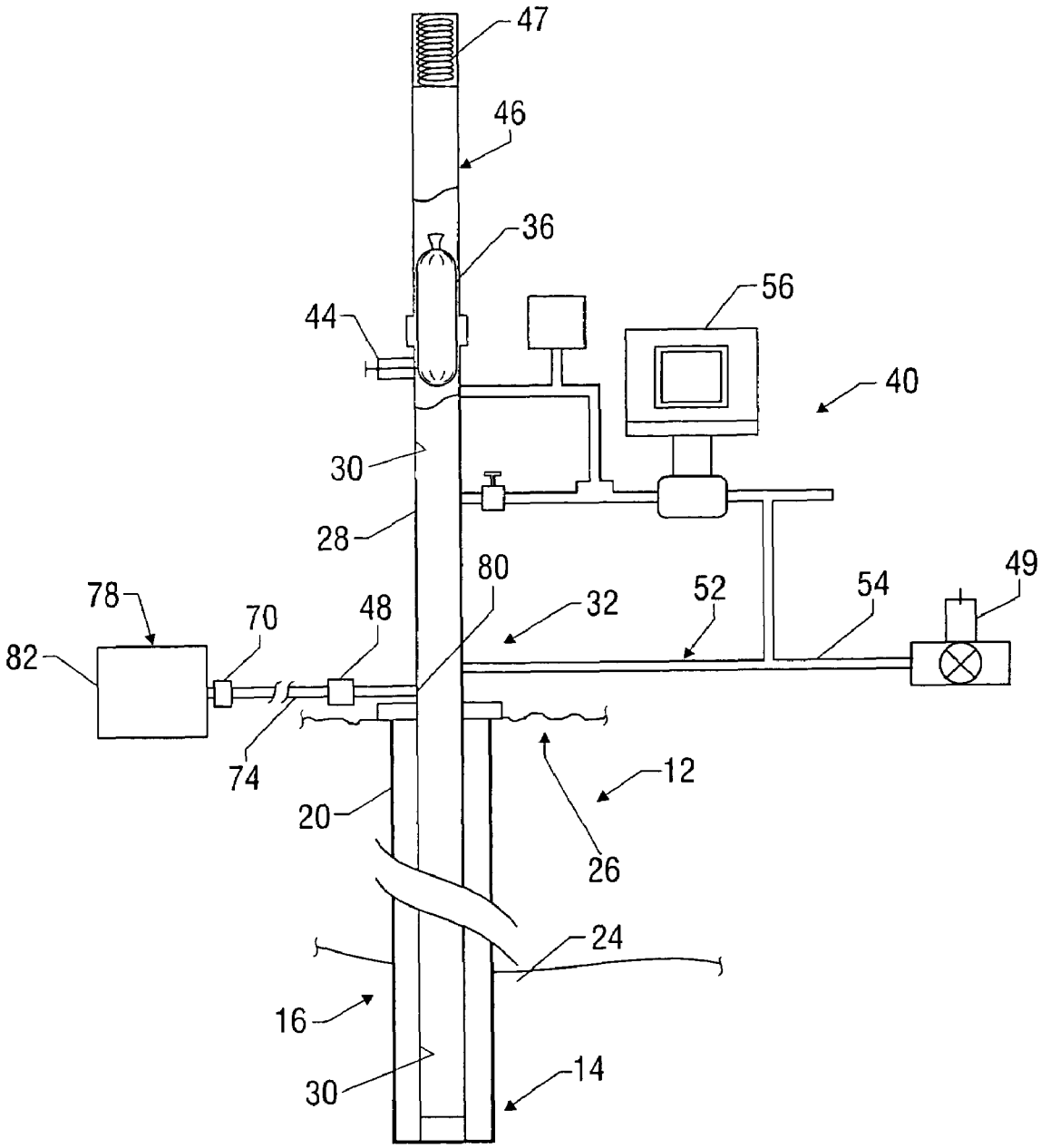
FIG. 2 is a longitudinal schematic showing an embodiment of a chemical delivery system of the present invention installed in an exemplary well equipped with a plunger lift system.

Now in accordance with an embodiment of the present invention, referring to FIG. 2, chemicals are insertable into the well before the plunger 36 drops back into the well 12. In this example, one or more chemical injection pump 70 is capable of dispensing chemicals through a chemical supply line 74 from a chemical supply source 78 into the tubing 28. The chemical insertion interface, or inlet, 80 into the tubing 28 is shown located below the position of the plunger 36 when the plunger 36 is held by the catcher 44 to ensure chemicals are insertable into the well 12 below the plunger 36. However, the inlet(s) 80 of this embodiment may be positioned anywhere, as long as chemicals are insertable into the well before the plunger 36 drops back into the well 12.

The chemicals may take any suitable form, composition and characteristics and may include one or more liquids, gels, films, oil-based products, solvent-based products, solids and/or gases, as desired. Examples of treatment chemicals that may be used are scale inhibitors, corrosion preventatives, paraffin inhibitors, microorganisms, foaming agents, gas expansion agents and multi-purpose chemicals. Fluid treatment chemicals, for example, may be water soluble and disperse in water in the well. It should be understood, however, the chemicals are in no way limiting upon the present invention.

The chemical injection pump 70, supply line 74 and supply source 78 may have any desired form, construction and configuration, and may be located as desired. Moreover, these components are not required for the present invention. For example, the chemicals may be manually poured, dumped or otherwise provided into the well 12 at the chemical insertion inlet(s) 80. For another example, chemicals may be provided into the well 12 through the flow control valve 49, such as with the use of a three-way valve.

In the illustrated embodiment, the chemical supply line 74 fluidly communicates with the tubing 28 through a check valve 48, which prevents produced fluids from flowing back to the supply source 78 from the well 12. In other embodiments, an electronically activated control valve (not shown) may be used in conjunction with the check valve 48 and/or multiple check valves (not shown) may be included. The illustrated chemical injection pump 70 may be a gas-operated, solar-powered or electric, high pressure chemical pump capable of pumping a high fluid volume in a short time and against a potentially significant backpressure from the well. Suitable pumps are presently commercially available from Texsteam, Wilden, Western, Solar Injection Systems, Inc., or Williams Milton Roy. The exemplary chemical supply source 78 is a chemical storage tank 82 located proximate to the well 12.

Still with reference to the embodiment of FIG. 2, the exemplary controller 56 controls the catcher 44, chemical injection pump 70, flow of well fluid out of the well 12 and insertion of chemicals into the well 12. Thus, the timing and duration of engagement and release of the plunger 36 and insertion of chemicals may be selectively established to optimize the desired chemical treatment scheme. If desired, the controller 56 may be capable of providing automatic insertion of a desired batch volume of chemicals at each plunger cycle or other intervals.

The controller(s) 56 may include one or multiple components and take any suitable form, arrangement and operation as is or becomes known. In the illustrated embodiment, the controller 56 is an electronic control system programmable to control the timing of engagement and disengagement of the catcher 44 with the plunger 36, operation of the chemical injection pump 70 and flow control valve 49.

A method of providing chemicals into a well in accordance with an embodiment of the present invention will now be described with reference to the example of FIG. 2. When the plunger 36 is pushed up the tubing 28 to the manifold 40 during normal operations, the plunger 36 is held above the well 12. Well production is allowed to exit the tubing 28. For example, the controller 56 may actuate the valve 49 to open the sales flow line 54 and the catcher 44 to hold the plunger 36.

When well production has sufficiently exited the tubing 28, or the well flow/pressure decreases to a desired level, the well 12 is shut-in. In the example shown, at a pre-set well pressure, the controller 56 closes the valve 49 to cut off the sales flow line 54. The plunger 36 remains held above the well 12 and chemicals may be inserted into the well 12. The chemicals may be provided in any desired manner. For example, fluid chemicals may be pumped, injected or poured into the tubing 28. For another example, solid chemicals may be effectively dumped into the tubing 28 to generally run down the inside wall 30 of the tubing 28 to the bottom 14 of the well 12 or other desired location. In the embodiment of FIG. 2, for example, after the controller 56 closes the motor valve 49, it actuates the chemical injection pump 70 to pump a batch volume of treatment chemicals through the chemical supply line 74 into the tubing 28 from the chemical supply source 78 for a pre-set duration.

In certain exemplary applications, water soluble scale and/or corrosion prevention chemicals may be inserted to treat water at or near the bottom 14 of the well 12, and as the treated water rises in the well 12, it is non-corrosive and/or non-scaling. For another example, in certain instances, such as in some gas producing wells, a filming corrosion inhibitor is coated along the entire inside wall 30 of the tubing 28 to prevent corrosion throughout operations.

If desired, the quantity of chemicals provided into the well 12 may be controlled, such as by controlling the speed of the pump 70, diameter of the piston of the pump 70, length of stroke of the pump 70, size of flow orifices in the chemical supply line 74, supply source 78 or insertion interface 80, a combination thereof or any other desired technique. In the exemplary embodiment, the chemical input quantity is controlled by duration of actuation and size of the chemical pump 70.

The quantity of chemicals may be based upon any desired variable(s), such as the type of chemical, desired action of the chemicals, frequency of insertion of the chemicals and nature and condition of the well 12. For example, the quantity of chemicals may be based, at least in part, upon the objective(s) of ensuring the chemicals reach the bottom 14 of the well 12 and/or uniformly coating the inner surface of the wall 30 of the tubing 28. Chemical input quantities may range, for example, from one cup to multiple gallons per insertion. In applications involving low pressure producing wells, for example, it may be desirable to use a minimal quantity (e.g. 2 gallons per day) of scale inhibitor chemicals sufficient to reach the bottom 12 of the well 14 and effectively treat the water therein. However, the present invention is not limited to the above examples or ranges of chemical volume.

The timing of chemical insertion may be based upon any desired variables. Depending upon the application, a steady state chemical treatment equilibrium of injected chemical volume and frequency may be desirable. For example, chemicals may be automatically inserted into the tubing 28 on every cycle or stroke of the plunger 36, such as to maintain chemicals in the tubing 28 continuously, or nearly-continuously, to provide uninterrupted treatment of well fluids. Alternatively, chemicals may not be inserted into the well 12 on every cycle or stroke of the plunger 36, but at other desired times or intervals. For example, chemicals may be inserted into the tubing 28 for a total of one, two or "x" times per day, at every $2^{nd}$, $3^{rd}$ or $n^{th}$ plunger cycle or otherwise as desired.

Still with reference to the example of FIG. 2, after the chemicals are inserted into the tubing 28, or otherwise when desired, the plunger 36 is released. In this embodiment, if the plunger cycle includes the insertion of chemicals, the plunger 36 follows the chemicals down the tubing 28, forcing the chemicals to the bottom of the tubing 28 where fluids are accumulating or other desired location(s), assisting in evenly dispersing the chemicals in the tubing 28, evenly distributing the chemicals across the inside wall 30 of the tubing 28 or for another suitable purpose. The type of plunger 36 may be selected to assist achieving the desired objective. For example, a brush plunger (e.g. item 62, FIG. 3B) may be used to assist in evenly distributing chemicals on the inside surface of the wall 30 of the tubing 28.

The timing of the release of the plunger 36 may be established depending upon any pertinent parameter(s), such as well pressure, chemical type or quantity and treatment objective. In the embodiment shown, for example, the controller 56 may be programmed to cause the catcher 44 to disengage with the plunger 36 immediately after a desired quantity of chemicals is inserted into the tubing 28. In some instances, it may be desirable to delay the release of the plunger 36 for a certain period of time to allow inserted chemical to begin its descent in the tubing 28. In other instances, it may be desirable to release the plunger 36 at some time during insertion of the chemicals into the tubing 28. For another example, when chemicals are inserted intermittently (not at every plunger cycle), the plunger 36 may be released as soon as the well 12 is shut-in for cycles not including the insertion of chemicals.

Preferred embodiments of the present invention thus offer advantages over the prior art and are well adapted to carry out one or more of the objects of the invention. However, the present invention does not require each of the components and acts described above and is in no way limited to the above-described embodiments, methods of operation, variables, values or value ranges. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims.

The methods described above and claimed herein and any other methods which may fall within the scope of the appended claims can be performed in any desired suitable order and are not necessarily limited to the sequence described herein or as may be listed in the appended claims. Further, the methods of the present invention do not necessarily require use of the particular embodiments shown and described in the present application, but are equally applicable with any other suitable structure, form and configuration of components.

While preferred embodiments of the invention have been shown and described, many variations, modifications and/or changes of the system, apparatus and methods of the present invention, such as in the components, details of construction and operation, arrangement of parts and/or methods of use, are possible, contemplated by the patent applicant(s), within the scope of the appended claims, and may be made and used by one of ordinary skill in the art without departing from the spirit or teachings of the invention and scope of appended claims. Thus, all matter herein set forth or shown in the accompanying drawings should be interpreted as illustrative, and the scope of the invention and the appended claims should not be limited to the embodiments described and shown herein.

The invention claimed is:

1. A method of delivering at least one treatment chemical in a liquid form into an underground hydrocarbon well equipped with a reciprocating plunger, the method comprising:

when the plunger is at an upstroke, retaining the plunger above the well;

shutting in the well;

continuing to hold the plunger above the well;

with the use of at least one chemical pump, dispensing at least one treatment chemical in a liquid form into the well; and releasing the plunger promptly after the at least one liquid treatment chemical is dispensed into the well, allowing the plunger to drop in the well after the at least one treatment chemical and assist in dispersing the at least one liquid treatment chemical throughout at least part of the well, distributing the at least one liquid treatment chemical along at least part of the inner surface of the well, pushing at least some of the at least one liquid treatment chemical to the bottom of the well or a combination thereof.

2. The method of claim 1 wherein a tubing is disposed within the well and wherein the plunger assists in distributing at least some of the liquid treatment chemicals across the inner surface of the tubing.

3. The method of claim 1 wherein after each upstroke of the plunger, the plunger is held, liquid treatment chemicals are automatically inserted into the well and the plunger is subsequently immediately released.

4. The method of claim 1 wherein liquid treatment chemicals are dispensed into the well intermittently as the plunger reciprocates in the well.

5. The method of claim 4 wherein after each upstroke of the plunger not followed by the insertion of liquid treatment chemicals into the well, the plunger is released as soon as the well is shut-in, and after each upstroke followed by the insertion of liquid treatment chemicals, the plunger is released immediately after insertion of the liquid treatment chemicals into the well.

6. A method of providing non-spherical chemicals into an underground well equipped with a plunger lift system, the plunger lift system including at least one plunger capable of moving up and down in a tubing disposed within the well and, on its upstroke, pushing well fluid out of the tubing into at least one flow passage, the method comprising:

providing at least one chemical insertion inlet into the tubing;

after an upstroke of the plunger, holding the plunger proximate to the top of the well;

closing the at least one flow passage to prevent fluid flow out of the well;

holding the plunger generally above the location of the at least one chemical insertion inlet;

inserting non-spherical chemicals into the well through the at least one chemical insertion inlet with the use of at least one chemical injection pump; and releasing the plunger to allow the plunger to drop in the well sufficiently soon after the non-spherical chemicals are inserted into the well so that the plunger will contact at least some of the non-spherical chemicals and be capable of assisting in at least one among dispersing at least some of the non-spherical chemicals throughout at least part of the well and delivering at least some of the non-spherical chemicals to at least one desired location within the well.

7. The method of claim 6 wherein the plunger pushes inserted chemicals to a desired location in the tubing.

8. The method of claim 6 wherein the plunger assists in evenly distributing chemicals across the inner surface of the tubing.

9. The method of claim 6 wherein after each upstroke of the plunger during normal operations, the plunger is automatically held proximate to the top of the well, the well is allowed to unload as desired, the well is shut in, a pre-established quantity of chemicals is automatically inserted into the well and the plunger is subsequently automatically released.

10. The method of claim 9 wherein the chemicals are treatment chemicals and treatment chemicals are continuously present in the well.

11. The method of claim 10 wherein the chemicals are fluid chemicals injected into the tubing.

12. The method of claim 6 wherein a pre-established quantity of chemicals is repeatedly inserted into the well after each occurrence of a pre-determined number of upstrokes of the plunger.

13. The method of claim 12 wherein the plunger is automatically held proximate to the top of the well, the well is allowed to unload as desired, the well is shut in, and when chemicals are not inserted into the well, the plunger is automatically released after the well is shut in, and when chemicals are inserted into the well, the plunger is subsequently automatically released.

14. The method of claim 6 wherein chemicals are inserted into the well at pre-established timed increments.

15. The method of claim 6 wherein the plunger is released immediately after insertion of the chemicals.

16. The method of claim 15 wherein the timing of release of the plunger and insertion of chemicals is selectively established to optimize chemical treatment in the well.

17. An apparatus for delivering at least one liquid chemical into an underground borehole equipped with a plunger lift system, the plunger lift system including a plunger capable of moving up and down in the borehole and a plunger catcher capable of holding the plunger generally above the borehole, the apparatus comprising:

at least one chemical supply source;

at least one chemical supply line in fluid communication with said chemical supply source and the borehole;

at least one chemical injection pump in fluid communication with at least one said chemical supply line and capable of pumping at least one liquid chemical into the borehole from at least one said chemical supply source; and at least one controller electronically engaged with said plunger catcher and capable of controlling the flow of fluids into the borehole from said at least one chemical supply source, wherein said at least one controller is configured to cause liquid chemicals to be automatically pumped by said at least one chemical injection pump into the borehole while the plunger is held by the plunger catcher and cause the plunger to be released into the borehole sufficiently soon thereafter to allow the plunger to contact the liquid chemicals and assist in delivering at least some of the liquid chemicals to one or more desired location within the borehole.

18. The apparatus of claim 17 wherein said at least one chemical injection pump is a gas-operated, high-pressure chemical pump.

19. The apparatus of claim 17 wherein said at least one chemical injection pump is an electric pump.

20. The apparatus of claim 17 wherein said at least one chemical injection pump is solar powered.

21. The apparatus of claim 17 wherein said at least one controller controls said at least one chemical injection pump.

22. The apparatus of claim 17 wherein said at least one chemical supply source is a chemical storage tank located adjacent to the borehole.

23. The apparatus of claim 17 further including at least one chemical insertion inlet into the borehole and in fluid communication with said at least one chemical supply line, said at least one chemical insertion inlet being located generally below the position of the plunger when the plunger is held by the plunger catcher.

24. The apparatus of claim 23 further including at least one valve in fluid communication with said at least one chemical supply line, wherein said at least one valve allows the flow of chemicals into the borehole through said at least one chemical insertion inlet and prevents the flow of fluid from the borehole to said at least one chemical supply source.

* * * * *

UNITED STATES PATENT AND TRADEMARK OFFICE

CERTIFICATE OF CORRECTION

PATENT NO. : 7,556,100 B2
APPLICATION NO. : 11/821373
DATED : July 7, 2009
INVENTOR(S) : Steiner It is certified that error appears in the above-identified patent and that said Letters Patent is hereby corrected as shown below:

In claim 1 at column 8, line 19, replace "chemical pump" with "chemical injection pump".

Signed and Sealed this

First Day of September, 2009

David J. Kappos

David J. Kappos
*Director of the United States Patent and Trademark Office*